United States Patent [19]

Schippers et al.

[11] 4,255,134

[45] Mar. 10, 1981

[54] YARN HEATING APPARATUS

[75] Inventors: Heinz Schippers; Peter Dammann, both of Remscheid-Lennep, Fed. Rep. of Germany

[73] Assignee: Barmag Barmer Maschinenfabrik Aktiengesellschaft, Remscheid, Fed. Rep. of Germany

[21] Appl. No.: 79,483

[22] Filed: Sep. 27, 1979

[30] Foreign Application Priority Data

Sep. 30, 1978 [DE] Fed. Rep. of Germany ... 7829136[U]

[51] Int. Cl.[3] ..... F27B 9/28

[52] U.S. Cl. ..... 432/59; 165/104 R; 219/540

[58] Field of Search ..... 432/8, 59; 165/105; 219/540

[56] References Cited

U.S. PATENT DOCUMENTS

| | | | |
|---|---|---|---|
| 2,958,921 | 11/1950 | Gilchrist et al. | 28/62 |
| 3,395,433 | 8/1968 | Kodaira et al. | 432/59 |
| 3,461,519 | 8/1969 | Raschle | 432/59 |
| 3,796,538 | 3/1974 | Howorth | 432/59 |

*Primary Examiner*—John J. Camby

*Attorney, Agent, or Firm*—Bell, Seltzer, Park & Gibson

[57] ABSTRACT

A yarn heating apparatus is provided which is adapted for use in a false twist yarn crimping machine or the like. The heating apparatus comprises an arcuately curved heater plate mounted in a generally vertical orientation within a channel in an insulated housing, and having one or more yarn receiving grooves extending along its length. A flat cover is hinged along one edge of the channel, and an insert is mounted on the inside of the cover. The inner face of the insert is curved in conformance with the curvature of the heater plate, such that when the door is closed, the inner face preferably sealably engages the heater plate to define a yarn passage of uniform cross-sectional configuration along the length of the heater plate. During operation of the machine, air rises along the vertically disposed yarn passage as a result of the chimney effect, to carry off the fumes emanating from the heated yarn. The uniform cross-sectional configuration of the passage minimizes heat loss by permitting the laminar flow of such air. Means are also provided for withdrawing the fumes directly from the yarn passage to prevent the same from entering the atmosphere.

9 Claims, 3 Drawing Figures

YARN HEATING APPARATUS

False twist yarn crimping machines are conventionally used in the processing of synthetic thermoplastic yarns, and serve to impart "false twist" to the yarn to improve its elasticity and bulk. Typically, such machines subject each of a plurality of running yarns to simultaneous twisting, heat setting, cooling, and untwisting operations, which results in the twist being permanently set into the yarn.

The heat setting of the yarn is conventionally effected by an arcuately curved heater plate having a length of about 1.2 to 1.5 meters and which has one or more longitudinally extending yarn receiving grooves in the outer convex surface thereof. The heater plate is mounted in a channel in a heat insulating housing, and is covered by an insulated flat cover which is hinged to the housing along the length of the channel to permit a yarn to be laterally inserted along the length of each groove.

Since the plate is usually oriented vertically or obliquely on the machine, air flows along the plate as a result of the chimney or stack effect, and absorbs heat from the plate which in turn results in a heat loss. A certain amount of such air flow is necessary however, in order to carry away the fumes of the finish or other chemical agents on the yarn which are vaporized upon the heating of the yarn, and which would otherwise condense and form as a sediment on the surface of the heater plate. Thus the clearance between the plate and cover can not be so small as to preclude adequate air flow for fume removal.

In order to reduce heat loss from the heater plate, it has been previously proposed to position an insert of heat insulating material on the inside of the cover, and such that the insert partially fills the area of the channel above the heater plate when the door is closed. In addition, in one such prior apparatus, the insert has inclined straight inner edge portions adjacent each end so that the insert more completely fills the deeper end portions of the channel which result from the arcuate curvature of the heater plate. Thus while the inner face of the insert may be said to somewhat conform to the arcuate convex face of the heater plate, the cross-sectional configuration of the clearance between the heater plate and insert will be seen to be non-uniform and vary substantially along the length of the plate.

It is an object of the present invention to more effectively reduce and minimize the heat loss from a heater plate of the described type, while providing for sufficient air flow to adequately remove the fumes emanating from the heated yarn.

It is also an object of the present invention to provide a yarn heating apparatus having provision for effectively collecting the fumes emanating from the heated yarn to prevent the same from exhausting to the atmosphere.

In accordance with the present invention, the above objects have been achieved through the discovery that the variable clearance between the yarn receiving groove of the heating plate and the cover or insert in the prior art heating apparatus results in a turbulent air flow along the length of the heater plate, and that such turbulent air flow increases the heat absorbed by the rising air and thus the heat loss from the plate. To minimize this turbulence and the resulting heat loss, the present invention provides an insert mounted on the inside of the cover, with the inner face of the insert being curved along its length in close conformance with the curvature of the heater plate. By this arrangement, the convex surface of the heater plate and the inner face of the insert define a passage of substantially uniform cross-sectional configuration along the length of the heater plate when the cover is closed. The uniform cross-sectional configuration provides for the laminar air flow within the passage, which minimizes heat loss, while permitting sufficient flow to carry off the fumes.

In one embodiment, the insert includes a sealing member at the inner face, which directly and conformingly contacts the convex surface of the heater plate when the cover is closed. Such sealing member thus acts to cover and close each yarn receiving groove on the heater plate, to thereby further reduce heat loss by minimizing heat radiation from the heater plate.

The sealing member of the present invention may take the form of a flexible metal strip which is mounted to the cover under longitudinal tension and such that the strip conformingly adapts to the convex configuration of the heater plate when the cover is closed. Alternatively, the sealing member of the present invention may be fabricated from a suitable resilient and heat resistant polymeric material, such as Teflon or silicone, and may take the form of a flat strip or a hollow tube. Where the seal is tubular, or where a closed cavity is provided between the seal and the inside face of the cover, the interior of the tubular seal or cavity may be connected to a duct system for exhausting air from the yarn passage to wash out the finishing agent fumes. More particularly, a plurality of apertures may be provided along the length of the seal, and a vacuum may be drawn in the interior of the tubular seal or cavity, so that the fumes are withdrawn through the apertures with the ambient air entering the ends of the yarn receiving groove. Also, the vacuum system may be designed in such a manner that a washing fluid is conveyed along the yarn receiving groove in a closed circulation system, such that the entry of room air is substantially precluded.

Some of the objects having been stated, other objects will appear as the description proceeds, when taken in connection with the accompanying drawings in which.

Figure 1:
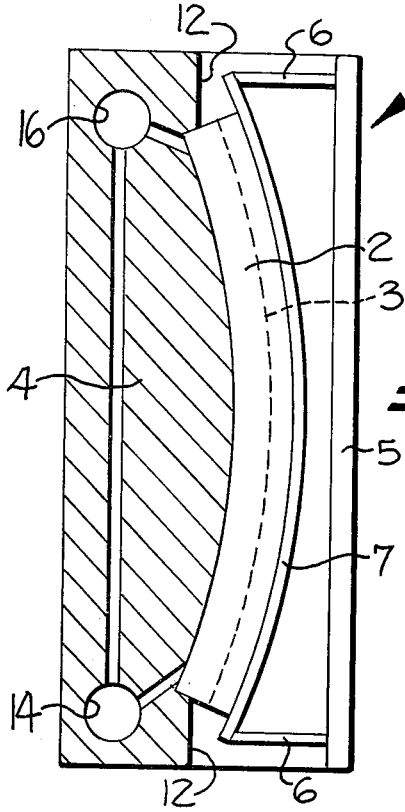
FIG. 1 is a schematic sectional side elevation view through a yarn heating apparatus which embodies the present invention.
Figure 2:
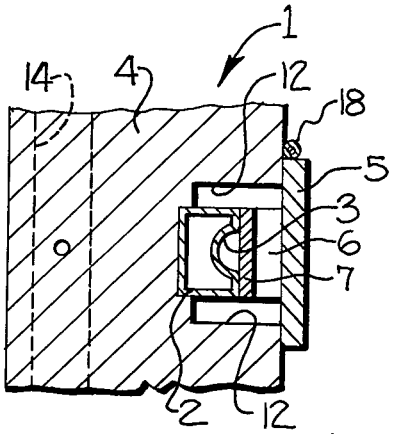
FIG. 2 is a sectional plan view of the heater shown in FIG. 1.

Referring more specifically to the drawings, FIGS. 1 and 2 illustrate a yarn heating apparatus 1 which embodies the present invention. In this regard, it will be understood by those skilled in the art that a number of such apparatus may be mounted in a side-by-side arrangement on an otherwise conventional false twist yarn crimping machine or the like, and with each heating apparatus being oriented in a generally vertical or oblique direction.

The yarn heating apparatus 1 as illustrated in FIGS. 1 and 2 comprises a heat insulating housing 4 having an elongate channel 12 formed therein. An elongate heater plate 2 is mounted within the channel of the housing. The plate has a uniform arcuate curvature in the longitudinal direction, and is provided with a longitudinally extending yarn receiving groove 3 in the outer convex surface thereof. The plate is disposed in the channel with the convex surface and the yarn receiving groove facing outwardly. As illustrated, the heater plate is part of a tube, the end of which are connected to ducts 14 and 16 which extend in a horizontal direction along the false twist machine. A heater element (not shown) is located in the lower duct 14 which heats and vaporizes a liquid, and the rising vapor condenses in the tube behind the heater plate and thereby elevates the temperature of the plate to the desired level in a conventional manner.

A cover 5 in the form of an elongate flat plate is hingedly connected to the housing 4 along the edge of the channel 12 for pivotal movement along a longitudinally directed axis 18. This pivotal movement permits the cover to be moved between a closed position covering the channel and overlying the heater plate and an open position wherein a yarn may be laterally inserted into the yarn receiving groove.

The apparatus further comprises insert means mounted on the inside of the cover. As seen in FIGS. 1 and 2, the insert means is in the form of an elongate flat sealing member 7 having an inner face which has a length and curvature which generally conforms to the length and curvature of the convex face of the heater plate 2, and a width sufficient to span the yarn receiving groove 3 of the heater plate. When the cover is closed, the inner face sealably contacts the side edges of the yarn receiving groove 3 to define a closed yarn passage of substantially uniform cross-sectional configuration along the entire length of the heater plate.

The sealing member 7 may be fabricated from a flexible metal strip, such as steel, and is preferably mounted under longitudinal tension between the holders 6 on the cover. When the cover is closed, the strip conformingly adapts even more closely to the arcuate configuration of the heater plate, by reason of the longitudinal tension being applied by the holders. Alternatively, the sealing member may be fabricated from a resilient and heat resistant polymeric material, such as Teflon or silicone. In any case, it will be seen that the sealing member firmly and resiliently contacts the lateral edges of the yarn receiving groove, and thereby avoids the formation of open cracks between the groove and sealing member which could engage and catch the running yarn.

Figure 3:
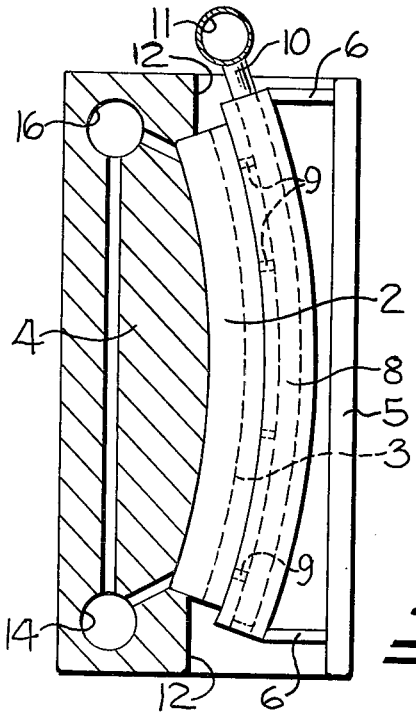
FIG. 3 is a sectional side elevation view of a second embodiment of a yarn heating apparatus which embodies the present invention.

In the embodiment of FIG. 3, the sealing member is in the form of a tubular member 8, and includes a plurality of apertures 9 spaced along its length, which communicate between the interior of the tubular member and the closed yarn passage when the door is closed. The tubular member 8 is suitably closed at its lower end, and its upper end is connected to a duct 10 which leads to a collection duct 11. Collection duct 11 connects all ducts 10 of the false twist machine to a pump (not shown) which can be used to draw a partial vacuum in the collection duct 11, causing the fumes emanating from the heated yarn to be withdrawn from the yarn passage through the openings 9, tubular member 8, and duct 10. In addition, it is contemplated that a closed cavity may be formed between the seal 7 and door 5 of the embodiment of FIGS. 1 and 2, which can be similarly connected to a duct system, to facilitate fume removal.

From the above description, it will be observed that the substantially uniform cross-sectional configuration of the closed yarn passage permits the air to move along the passage under laminar flow conditions, which minimizes the heat absorbed by the air and thus heat loss. Further, by sealably covering the yarn receiving groove, the seal acts to minimize heat loss from radiation.

While the illustrated embodiment of the invention discloses a single yarn receiving groove in the heater plate, it will be understood that the invention is equally applicable to a heater plate having a plurality of parallel grooves formed therein.

In the drawings and specification, there has been set forth a preferred embodiment of the invention, and although specific terms are employed, they are used in a generic and descriptive sense only and not for purposes of limitation.

That which is claimed is:

1. A yarn heating apparatus for use in a false twist yarn crimping machine or the like, and comprising a heat insulating housing having an elongate channel formed therein, an elongate heater plate having a uniform arcuate curvature in the longitudinal direction and an outer convex face, said heater plate being mounted within said channel of said housing with said convex face facing outwardly, heating means operatively connected to said heater plate for elevating the temperature thereof, an elongate cover hingedly connected to said housing for movement about a longitudinally directed axis and between a closed position covering said channel and overlying said heater plate, and an open position, a flexible sealing member means having an inner face which has a length and curvature which is adapted to generally conform to the length and curvature of said convex face of said heater plate, and means mounting said sealing member to the inside of said cover such that the convex surface of said heater plate and the inner face of said sealing member define a passage of substantially uniform cross-sectional configuration along the length of said heater plate and said inner face of said sealing member directly and conformingly contacts said convex face of said heater plate when said cover is closed, whereby when the cover is open, access is permitted to the heater plate to facilitate insertion of a yarn therealong, and when the cover is closed, the uniform cross-sectional configuration of said passage minimizes the heat loss normally resulting from air flowing through the passage by permitting the laminar flow of such air.

2. The yarn heating apparatus as defined in claim 1 further comprising means for withdrawing the fumes emanating from a heated yarn passing along said heater plate and comprising cavity means positioned between said cover and said inner face of said sealing member, and extending longitudinally along substantially the full length of said inner face, a plurality of longitudinally spaced apart apertures extending through said inner face and communicating between said passage and said cavity means when said cover is closed, and duct means operatively connected to the interior of said cavity means for withdrawing air therefrom, whereby air and the fumes emanating from the heated yarn may be withdrawn through said apertures and cavity means.

3. The yarn heating apparatus as defined in claim 1 wherein said heater plate further includes at least one longitudinally extending yarn receiving groove in the convex face thereof.

4. The yarn heating apparatus as defined in claim 3 wherein said sealing member comprises a flexible metal strip.

5. The yarn heating apparatus as defined in claim 3 wherein said sealing member comprises a resilient polymeric material.

6. A yarn heating apparatus for use in a false twist yarn crimping machine or the like, and comprising a heat insulating housing having an elongate channel formed therein, an elongate heater plate having a uniform arcuate curvature in the lengthwise direction and at least one longitudinally extending yarn receiving groove in the convex face thereof, said heater plate being mounted within said channel of said housing with the convex face and each yarn receiving groove facing outwardly, heating means operatively connected to said heater plate for elevating the temperature thereof, a generally flat cover hingedly connected to said housing for movement about a longitudinally directed axis and between a closed position covering said channel and overlying said heater plate, and an open position, a flexible sealing member having an inner face which is adapted to be curved along its length in conformance with the curvature of said heater plate and a width sufficient to span each yarn receiving groove, and means mounting said sealing member to the inside of said cover such that said inner face sealably and conformingly contacts said convex face of said heater plate and spans each yarn receiving groove to define a passage of substantially uniform cross-sectional configuration along the length of said heater plate when said cover is closed, whereby when the cover is open, access is permitted to the heater plate to facilitate insertion of a yarn therealong, and when the cover is closed, the uniform cross-sectional configuration of said passage minimizes the heat loss normally resulting from air flowing through the passage by permitting the laminar flow of such air.

7. The yarn heating apparatus as defined in claim 6 further comprising means for withdrawing the fumes emanating from a heated yarn passing along said heater plate and comprising cavity means positioned between said cover and said inner face of said sealing member, and extending longitudinally along substantially the full length of said sealing member, a plurality of longitudinally spaced apart apertures extending through said inner face of said sealing member and communicating between said passage and said cavity means when said cover is closed, and duct means operatively connected to the interior of said cavity means for withdrawing air therefrom, whereby air and the fumes emanating from the heated yarn may be withdrawn through said apertures and cavity means.

8. The yarn heating apparatus as defined in claim 7 wherein said sealing member comprises a resilient tubular member, and wherein the interior of said tubular member comprises said cavity means.

9. The yarn heating means as defined in claim 6 wherein said sealing member comprises a flexible strip, and said mounting means comprises means for supporting the ends of said strip, and whereby the strip conformingly adapts under longitudinal tension to the arcuate configuration of the heater plate when the cover is closed.

* * * * *